US005128689A

United States Patent [19]

Wong et al.

[11] Patent Number: 5,128,689

[45] Date of Patent: Jul. 7, 1992

[54] EHF ARRAY ANTENNA BACKPLATE INCLUDING RADIATING MODULES, CAVITIES, AND DISTRIBUTOR SUPPORTED THEREON

[75] Inventors: Harry Wong, Monterey Park; Stanley S. Chang, Palos Verdes Estates; Donald C. Chang, Thousand Oaks; Kenneth C. Kelly, Sherman Oaks, all of Calif.

[73] Assignee: Hughes Aircraft Company, Los Angeles, Calif.

[21] Appl. No.: 585,553

[22] Filed: Sep. 20, 1990

[51] Int. Cl.[5] ..... H01Q 21/00; H01Q 23/00; H01P 5/00

[52] U.S. Cl. ..... 343/853; 333/125; 333/134; 333/137

[58] Field of Search ..... 333/125, 126, 134, 135, 333/137, 129; 343/778, 777, 853

[56] References Cited

U.S. PATENT DOCUMENTS

| | | | |
|---|---|---|---|
| 2,905,940 | 9/1959 | Spencer et al. | 343/778 |
| 2,908,906 | 10/1959 | Kurtz | 343/778 X |
| 3,030,592 | 4/1962 | Lamb et al. | 338/248 X |
| 4,382,239 | 5/1983 | Chen et al. | 333/248 |
| 4,614,920 | 9/1986 | Tong | 333/135 |
| 4,688,007 | 8/1987 | Krill | 333/248 X |
| 4,771,294 | 9/1988 | Wasilousky | 343/853 |
| 4,939,527 | 7/1990 | Lamberty et al. | 343/778 X |
| 4,987,425 | 1/1991 | Zahn et al. | 343/853 |

FOREIGN PATENT DOCUMENTS

| | | | |
|---|---|---|---|
| 31201 | 2/1987 | Japan | 333/125 |

*Primary Examiner*—Eugene R. Laroche
*Assistant Examiner*—Benny T. Lee
*Attorney, Agent, or Firm*—Gordon R. Lindeen, III; Steven M. Mitchell; Wanda K. Denson-Low

[57] ABSTRACT

An EHF array antenna backplate that integrates thermal cooling structure and signal processing structure together into one unified structure. In one embodiment, forced air is employed to conduct heat from active modules; while in another embodiment, embedded heat pipes are employed. The array backplate is made by using four layers. The layers are: a high density multichip interconnect board, a metal matrix composite motherboard, an integrated waveguide/cavity/cooling structure, and a metal matrix composite baseplate. Each module uses solder bumps to connect to the high density multichip interconnect board where DC power and control logic signal distribution takes place. The modules are soldered in four locations to the metal matrix composite motherboard through openings in the high density multichip interconnect board. EHF signals are coupled to the modules from a resonant cavity via probes that protrude through the high density multichip interconnect board. Probes are strategically located in the resonant cavity to pick up an EHF standing wave generated by slots that are part of a slotted planar waveguide EHF 16-way power divider network. The waveguide/cavity/cooling structure is also the primary load-bearing member of the backplate.

30 Claims, 4 Drawing Sheets

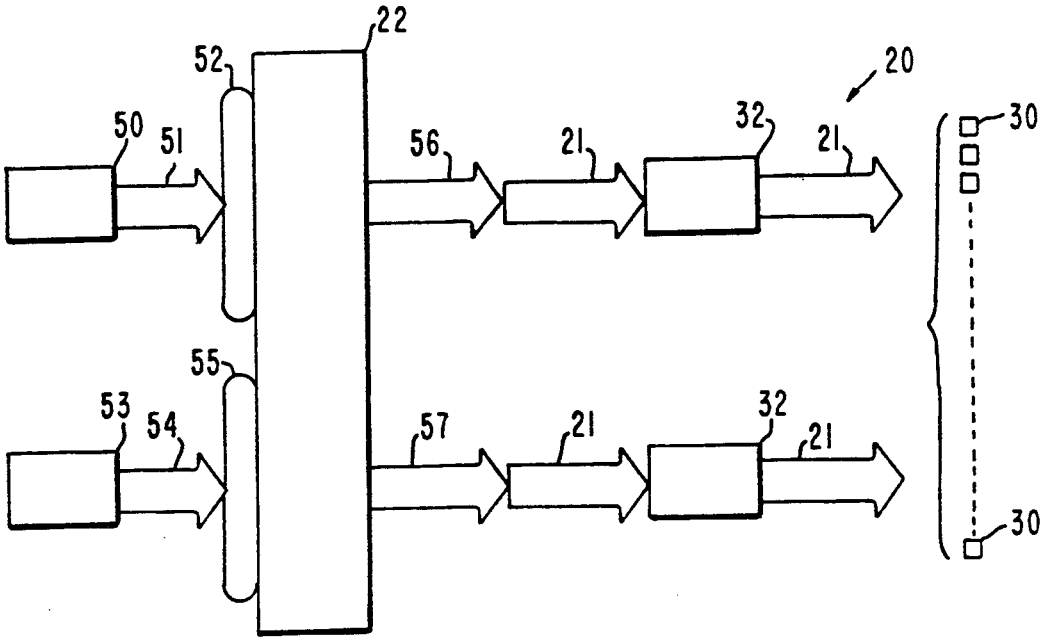
Fig. 6a.
Fig. 6b.
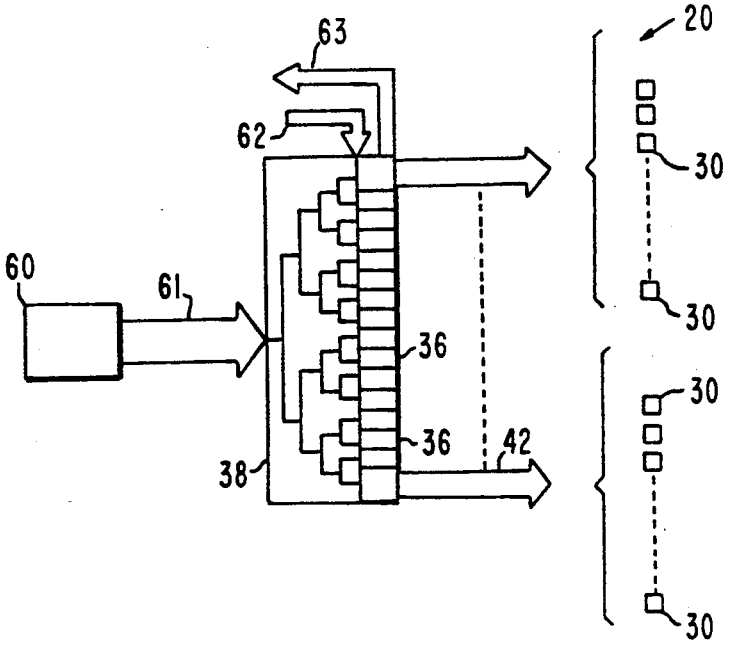

EHF ARRAY ANTENNA BACKPLATE INCLUDING RADIATING MODULES, CAVITIES, AND DISTRIBUTOR SUPPORTED THEREON

BACKGROUND

The present invention relates to a phased array antenna and, more particularly, to methods for constructing and apparatus comprising the backplate of phased arrays that incorporate active electronic modules.

Present trends are to provide advances in phased array antennas for the EHF or millimeter wave frequency band. This band is roughly from 30–300 GHz, which corresponds to a wavelength of 1 cm–1 mm. The goal is to provide high power, light-weight and low cost antennas for the EHF band. Antenna arrays at the EHF band incorporate heat producing devices in the backplate thereof. These heat producing devices may include GaAs FET diodes, hybrid circuits, MMIC chips, VHSIC gate arrays, monolithic subarrays or other types of semiconductor devices or modules. Heat is also produced by RF transmission and distribution devices such as feed networks, planar waveguide power dividers, and the like. Furthermore, heat is also produced by the DC power distribution and buffering, as well as by control logic signal distribution and processing.

The complete antenna array with its backplate comprises a miniaturized structure having multiple layers. The purpose of the array backplate is to provide EHF signal distribution, DC power distribution, logic signal distribution, thermal management, and structural rigidity for subarray modules to be mounted thereon. It is desired that the EHF signal distribution be efficient (low signal loss), simple and highly reliable. It is also desired that the backplate be thin and light in weight. In particular, a thickness of 0.5 inch facilitates low profile mounting of the antenna array on aircraft.

It is an objective of the present invention to reduce or eliminate large number of thermal contact interfaces usually found in the cooling systems of conventional array backplates. It is also an objective to provide an array backplate that eliminates or reduces the high parts count typically found in conventional array backplates. Another objective is the provision of an array backplate that does not require a labor-intensive manufacturing process.

SUMMARY OF THE INVENTION

In accordance with these and other objectives and features of the present invention, there is provided a novel EHF array antenna backplate that integrates the thermal cooling structure and the signal processing structure together into one unified structure. In airborne applications, forced air is employed to conduct heat from the active modules; while in spaceborne applications, metal matrix composite materials or heat pipes are employed. The array backplate is a very simple structure that is comprised of only four layers. The layers are: a high density multichip interconnect board, a metal matrix composite motherboard, an integrated waveguide/cavity/cooling structure, and a metal matrix composite baseplate. The backplate accommodates various types of subarray modules. The DC and logic lines of each subarray module use solder bumps to connect to the high density multichip interconnect board where DC power and control logic signal distribution takes place. The base of the subarray modules is soldered in four locations to the metal matrix composite motherboard through openings in the high density multichip interconnect board. This provides structural rigidity and facilitates heat dissipation from the active modules.

EHF signals are electromagnetically coupled to the subarray modules from a resonant cavity via probes that are attached to the subarray modules and which protrude through the high density multichip interconnect board. Probes are strategically located in the resonant cavity to pick up the EHF standing wave generated by slots provided in the floor of the cavity. The slots are part of a slotted waveguide EHF 16-way power divider network that only has 0.023 dB attenuation per inch. Total insertion loss from the EHF feed to the subarray modules via 256 power divisions is approximately 25.8 dB. In a backplate used for signal reception rather than transmission, the EHF signal distribution works using the same principle, only the signals travel in the reverse direction. Two openings are provided at the side of the waveguide/cavity/cooling structure through which cooling air is fed into the resonant cavities. This technique is an efficient impingement air cooling system. The waveguide/cavity/cooling structure is also the primary load-bearing member of the backplate. In space borne applications, the air cooling system is replaced with imbedded heat pipes or matrix composite materials.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which:

FIG. 6*a* is a diagram illustrating the distribution of signals and cooling air in the array backplate showing the control logic signal and DC power distribution; FIG. 6*b* is a diagram similar to that of FIG. 6*a* showing the EHF signal and cooling air distribution;

DETAILED DESCRIPTION

Figure 1:
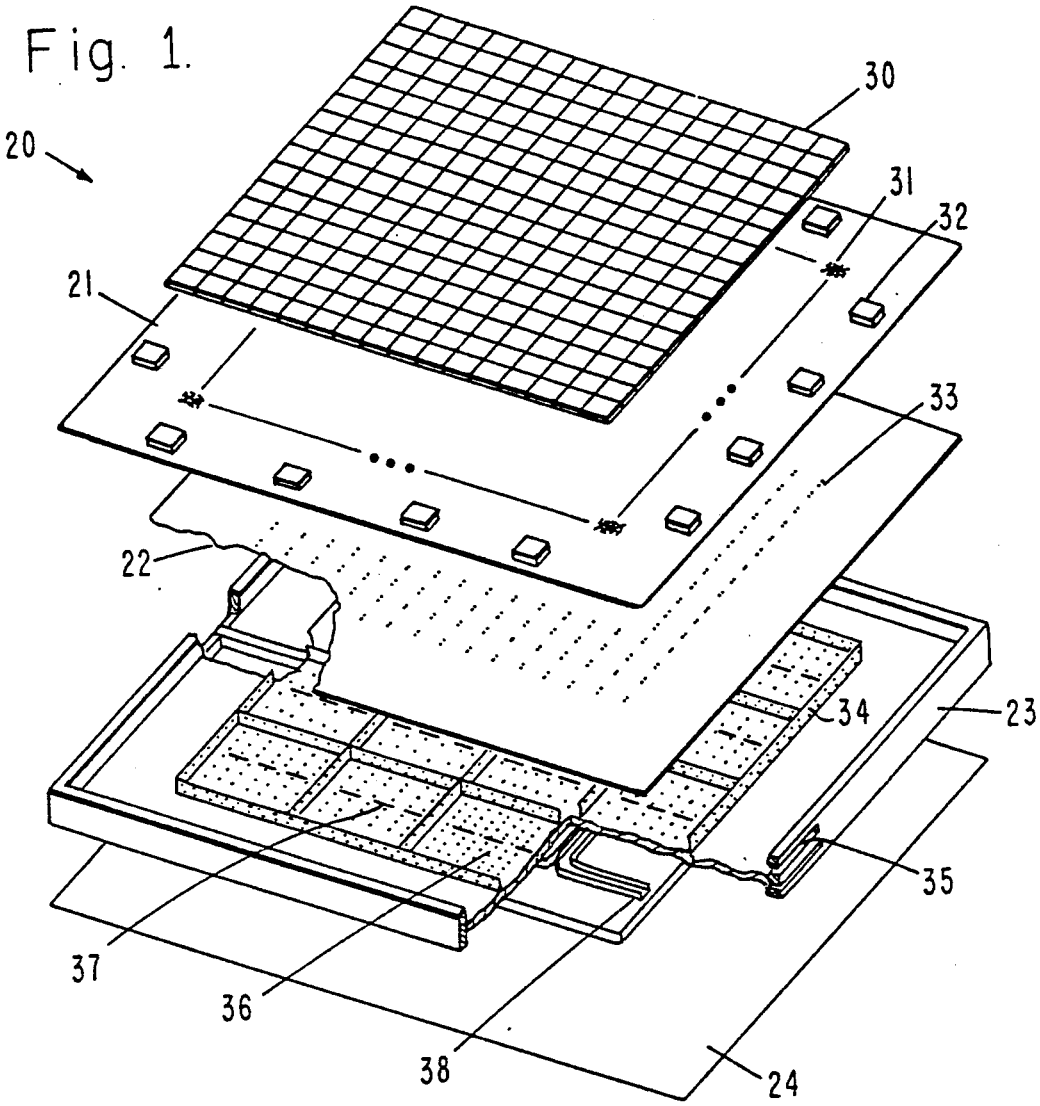
FIG. 1 is an exploded view of an array backplate in accordance with the invention showing the four principal structural layers thereof.

Referring now to FIG. 1 of the drawings, there is shown an exploded view of an array backplate 20 constructed in accordance with the principles of the present invention. The array backplate 20 is a very simple structure that is comprised of four main structural layers 21, 22, 23, 24. The first layer 21 is a high density multichip interconnect board that provides distribution of control signals and DC power on a multilayer substrate. The second layer 22 is a metal matrix composite motherboard that provides a substraate for the physical support of active semiconductor elements. The third layer 23 of the array backplate 20 is a combined or integrated waveguide and resonant cavity and cooling structure. The third layer 23 is also the primary load-bearing member of the backplate 20. The fourth layer 24 is a metal matrix composite baseplate which serves as a cover plate for the backplate 20.

As shown in FIG. 1, an array of subarray modules 30 is provided, and in the present example, there are 256 modules 30 arranged in a 16×16 array. The first layer 21, which is directly below the modules 30, is provided with coupling means 31 for each module 30, the coupling means 31 including thermal vias and solder bumps. The DC power and logic lines of each module 30 use solder bumps to connect to the high density multichip interconnect board where DC power and control logic signal distribution take place. Around the outer periphery of the first layer 21, there are provided a plurality of support modules 32, which may include buffers and power conditioners for processing the DC power and logic control signals. The second layer 22 is provided with a plurality of openings 33 which serve as vertical feedthrough holes for EHF signal probes, and there is an opening 33 for each subarray module 30. The third layer 23 is provided with a plurality of air holes 34 in the interior thereof, and cooling air input/output ports 35 around the exterior thereof. The third layer 23 is also provided with a plurality of resonant cavities 36, there being 16 resonant cavities 36 in the present exemplary embodiment. Each resonant cavity 36 has coupling slots 37 for coupling to an EHF planar slotted waveguide 16 way power divider network 38 disposed directly below the floor of the resonant cavities 36.

In this embodiment of the array backplate 20, the arrangement of the four structural layers 21, 22, 23, 24, the EHF feed power divider networks 38, and the cooling system components allows the simultaneous EHF signal distribution and air cooling function to be accomplished in a single structure, namely the third layer 23. In this embodiment, the forced cooling air is channeled through the EHF resonant cavity 36 to directly cool the heat source while maintaining high EHF signal efficiency and high thermal efficiency. This embodiment of the invention also allows the array backplate 20 to be thin and lightweight because it avoids using cold plates, heat sinks and cooling fins such as are used in conventional EHF array backplates.

Figure 2:
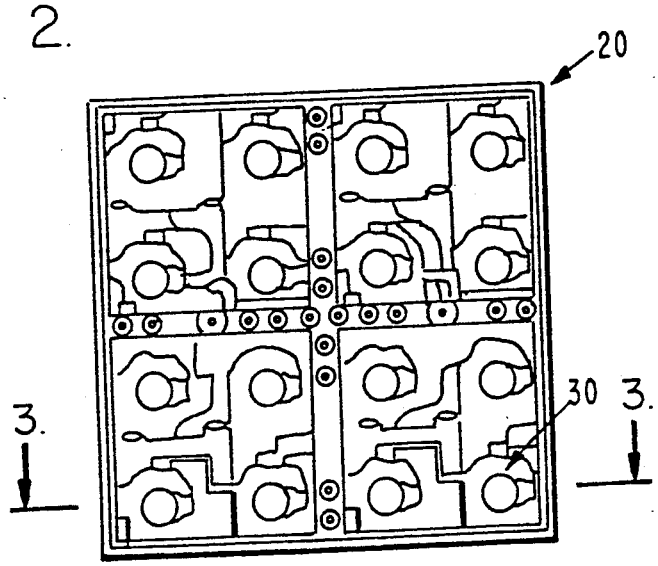
FIG. 2 is a plan view of an EHF array antenna backplate showing a plurality of subarray active modules disposed thereon.
Figure 3:
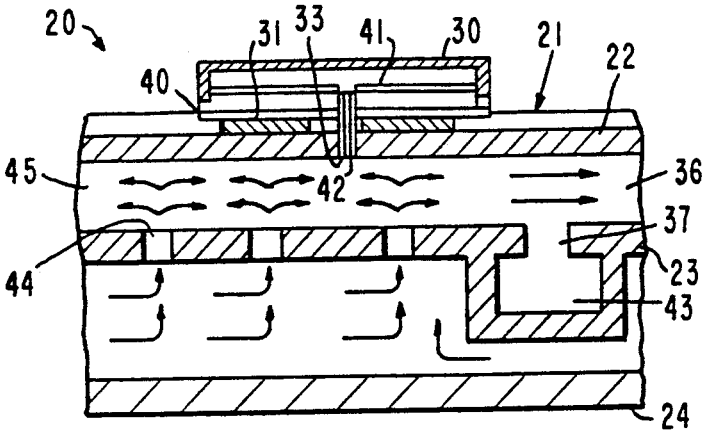
FIG. 3 is an enlarged cross section of a portion of the array backplate shown in FIG. 2 taken along the lines 3—3.

FIG. 2 is a plan view of an EHF array backplate 20 having a plurality of active subarray modules 30 disposed thereon. FIG. 3 is an enlarged cross-section of a portion of the array backplate 20 shown in FIG. 2 taken along the lines 3—3. The active subarray module 30 is above and connected to the first layer 21 which is the high density multichip interconnect board that distributes DC power and logic control signals. However, the module 30 is physically fastened to and supported by the second layer 22, the metal matrix composite motherboard, by means of solder connections 40 which pass through openings provided in the first layer 21. Specifically, the base of the subarray module 30 is soldered in four locations to the metal matrix composite motherboard. This provides structural rigidity and facilitates heat dissipation from the module 30. A coupling means 31 on the first layer 21 includes a thermal via for heat conduction from the module 30 to the second layer 22. The subarray module 30 is provided with a radiating element 41 for radiating EHF signals outwardly from the array backplate 20. An EHF probe 42 extends through the opening 33 in the second layer 22 to couple into the resonant cavity 36. The opening 33 may be filled with Teflon around the EHF probe 42. A slotted waveguide 43 couples EHF signal energy into the resonant cavity 36 by means of the coupling slot 37. Air cooling holes 44 are provided in the third layer 23 to permit air 45 to circulate below the subarray module 30.

Figure 4:
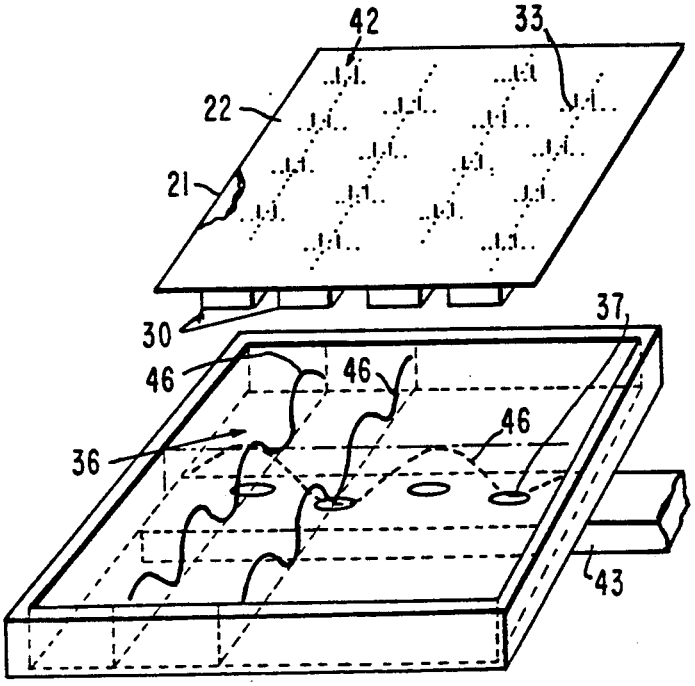
FIG. 4 is a perspective view of the combined waveguide and resonant cavity and cooling structure with its cover removed.

FIG. 4 shows a simplified view of the interior of one of the resonant cavities 36 with its cover opened and lifted off of it. The cover comprises the combined first layer 21 and the second layer 22 and the subarray modules 30 that are connected electrically and physically thereto. The cover is shown upside down relative to the integrated waveguide and resonant cavity layer 23 to better illustrate the probes 42 which extend from the bottom of the cover into the resonant cavities. FIG. 4 shows the EHF pick-up probes 42 protruding through the openings 33 provided therefor in the second layer 22. The slotted waveguide 43 which is a part of the 16-way power divider network 38 passes beneath the floor of the resonant cavity 36. The mode probe excitation coupling slots 37 couple the EHF energy from the slotted waveguide 43 into the resonant cavity 36 setting up standing waves 46 in a predetermined standing wave pattern. When the cover is closed, the probes 42 are strategically located in the resonant cavity 36 to pick up the EHF standing wave 46 generated by the slots 37 in the floor of the cavity 36. The slots 37 are actually a part of the slotted waveguide 43 which is in turn a part of the EHF 16-way power divider network 38. The EHF signal distribution arrangement just described may be considered to be a non-physical, resonator-fed, distribution means for the EHF signal. This non-physical, resonator-fed arrangement is low-loss, simple and insures high reliability.

Figure 5:
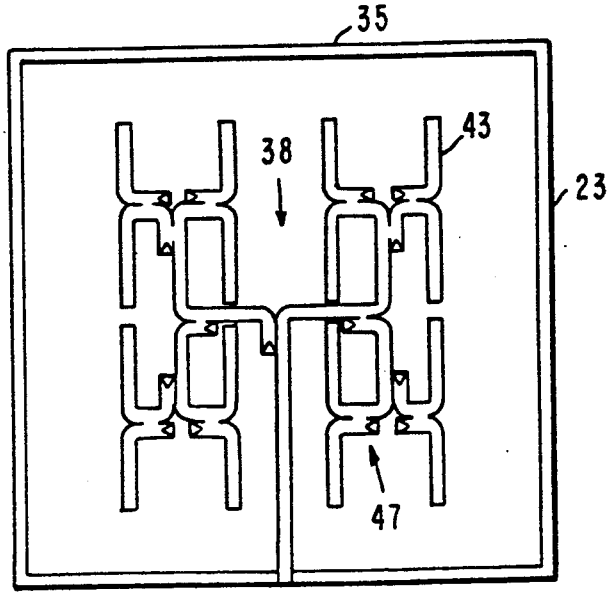
FIG. 5 is a bottom view of the third layer of the backplate showing the 16-way power divider network below the floor of the resonant cavities.

FIG. 5 is a bottom view of the third layer 23 comprising the integrated waveguide, cavity, and cooling structure, showing the low-loss, planar slotted waveguide EHF 16-way power divider network 38. The power divider network 38 employs a plurality of high isolation, short block 3 dB hydrids 47. The EHF planar waveguide power divider network 38 constructed with the 3 dB hybrids 47 has low-loss and provide excellent isolation between ports. Typically, the power divider network 38 has only 0.023 dB attenuation per inch, and the total insertion loss from the EHF feed to the subarray modules 30 via 256 power divisions is approximately 25.8 dB.

The foregoing description of the EHF signal feed applies to an array backplate 20 when used to transmit EHF signals. When an array backplate 20 is adapted to receive EHF signals instead of transmit, it operates on the same principles, except that the signals travel in the reverse direction.

FIGS. 6*a* and 6*b* are schematic block diagrams in block illustrating signal flow and cooling air flow in the array backplate 20 of the present invention. FIG. 6*a* shows the control logic signal and DC power distribution. An aircraft on which the EHF antenna array is installed has a DC power source 50 connected by a cable 51 and connector 52 to the second layer 22 of the array backplate 20 which comprises the metal matrix composite motherboard. Similarly, a central processing unit (CPU) 53 is connected by way of a cable 54 and connector 55 to the second layer 22 of the array backplate 20. The DC power and control logic signals pass through vertical feedthroughs 56, 57 to the first layer 21 which is the high density multichip interconnect. There, the DC power and control logic signals are routed to support modules 32 which comprise power conditioners and buffers. From the support modules 32, the DC power and control logic signals are distributed to the subarray modules 30.

Referring now to FIG. 6*b* which shows the EHF signal and cooling air distribution, a communication system 60 provides an EHF signal via an EHF waveguide 61 to the EHF 16-way planar waveguide power divider network 38. The EHF signal is distributed to the 16 resonant cavities 36. The 256 probes 42 couple the EHF signal energy to the 256 subarray modules 30 for radiation away from the backplate 20. A source of forced air (not shown) provides air to an input port 62 of the resonant cavities 36. The air exits the resonant cavities 36 via an output port 63.

The embodiment of the invention described above exemplifies a unique backplate technology that is useful in the field of EHF phases array antennas having a plurality of heat dissipating active modules. It is a feature of the present invention that the backplate technology incorporates a unique integrated approach in which the thermal structure and the RF distribution structure are combined together into one unified structure. The invention is not limited to the embodiment described above in which forced air is employed to conduct heat from the active modules.

Figure 7:
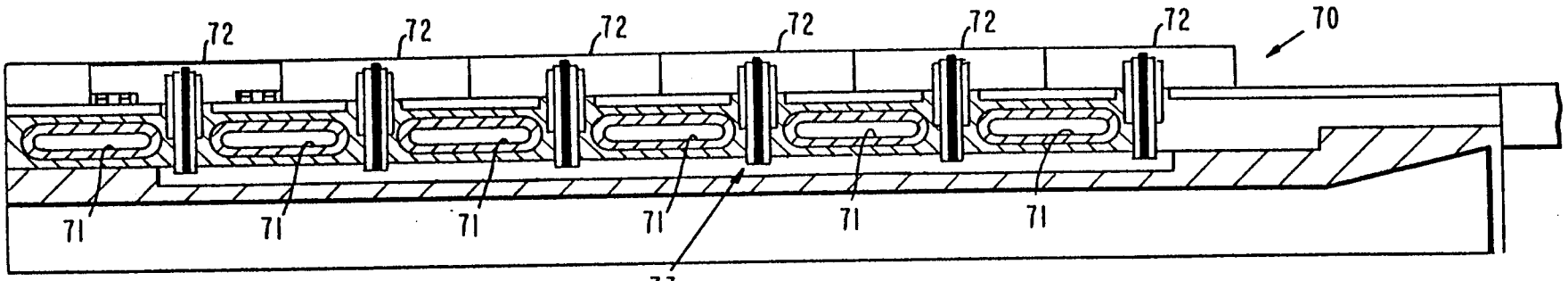
FIG. 7 is a cross-sectional view of a second embodiment of an array backplate employing imbedded heat pipes for cooling active modules.
Figure 8:
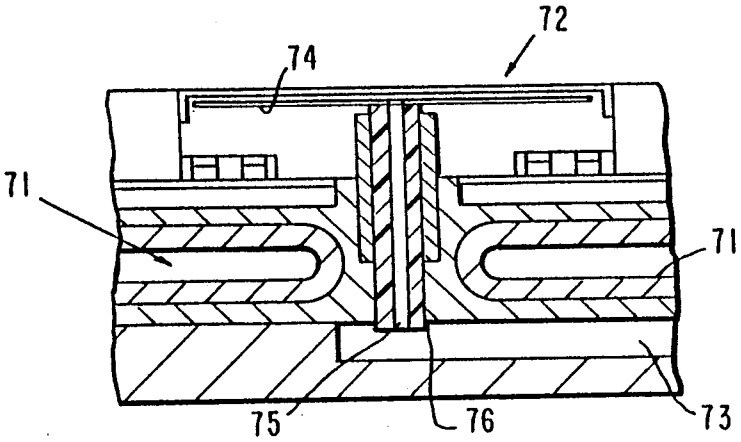
FIG. 8 is an enlarged view of a portion of the embodiment of the backplate of FIG. 7 showing details of one of the active modules.

Referring now to FIG. 7, there is shown an embodiment of an EHF array backplate 70 employing heat pipes 71 to conduct heat away from active modules 72. This embodiment of the present invention is useful both in space and airborne applications. The EHF signal distribution is accomplished by means of a resonant cavity 73. FIG. 8 shows an enlarged view of a portion of the embodiment of the backplate 70 of FIG. 7 illustrating details of one of the active modules 72. The active module 72 is illustrated as being a monolithic microwave integrated circuit (MMIC) although the backplate 70 may be adapted for many other types of active modules 72. As may be seen in FIG. 8, the heat pipes 71 are imbedded in the wall of the structure that forms the resonant cavity 73. The active module 72 has a radiating element 74 and an EHF signal probe 75 that protrudes into the cavity 73. The probe 75 typically is surrounded by a Teflon member 76.

Thus there has been described a new and improved EHF array antenna backplate that allows simultaneous EHF signal distribution and module cooling functions to be accomplished in a single structure. The non-physical resonstor-fed signal distribution arrangement is low-loss, simple, and insures high reliability. The cooling system interposes a minimal number of thermal contact interfaces which results in an efficient thermal management system. In airborne applications, forced air is used to conduct heat from the active modules, while in space borne or airborne applications, metal matrix composite materials or imbedded heat pipes are employed to conduct the heat away from the active modules. It is to be understood that the above-described embodiments are merely illustrative of some of the many specific embodiments which represent applications of the principles of the present invention. Clearly, numerous and other arrangements can be readily devised by those skilled in the art without departing from the scope of the invention.

What is claim is:

1. An EHF band wave distributor comprising first and second layers, the first layer comprising:

a two dimensional array of subarray modules; and a plurality of probes, each probe being associated with a respective subarray module; and the second layer comprising:

a two dimensional array of resonant cavities for supporting standing waves, each cavity being associated with a respective subarray module;

a waveguide network for distributing EHF energy;

a plurality of slots disposed between the cavities and the network for electromagnetically communicating the EHF energy from the network to each respective cavity thereby establishing a standing wave in each respective cavity; and a plurality of radiating elements each element being associated with a respective subarray module, wherein each probe extends into a respective cavity for electromagnetically coupling the respective radiating element to the standing wave within the respective cavity.

2. The distributor of claim 1 further comprising a fifth layer disposed between the resonant cavities and the subarray modules for providing interconnections between the subarray modules and external power and control signals.

3. The distributor of claim 1 further comprising a third layer comprising a sheet of metal matrix composite for providing a top cover for the resonant cavities through which cover the probes extend to electromagnetically couple each respective radiating element to the standing waves within each respective cavity.

4. The distributor of claim 1 further comprising a fourth layer comprising a metal matrix composite sheet for providing a bottom cover for the distributor.

5. The distributor of claim 1 wherein the second layer further defines a network of cooling fluid channels disposed adjacent the resonant cavities.

6. The distributor of claim 5 further comprising a third layer comprising a metal matrix composite sheet for providing a bottom cover for the distributor and for defining a bottom wall of the cooling channels.

7. The distributor of claim 1 further comprising an array of heat pipes associated with said first and second layers for conducting heat away from the resonant cavities.

8. The distributor of claim 7 wherein the heat pipes are disposed between the first and second layers.

9. A multiple layer EHF band wave distributor comprising:

a first layer comprising a metal matrix composite motherboard for providing structural rigidity and heat conduction for the multiple layer distributor;

a second layer disposed below the first layer comprising a resonant cavity, means for cooling the distributor thermally coupled to the cavity and a non-physical resonator-fed wave distribution system having waveguide slots for electromagnetically coupling waves in the distribution system into the cavity; and a third layer disposed below the second layer comprising a metal matrix composite baseplate that provides a bottom cover for the distributor.

10. The distributor of claim 9 further comprising a fourth layer disposed proximate the first layer having an array of subarray modules containing coupling probes for electromagnetically coupling respective radiating elements to the cavity.

11. The distributor of claim 10 further comprising a fifth layer disposed above the first layer and comprising a high density interconnect layer for providing DC power and control logic signals to the subarray modules.

12. The distributor of claim 9 wherein the cooling means comprises an array of heat pipes disposed adjacent the resonant cavity.

13. The distributor of claim 9 wherein the cooling means comprises a network of cooling fluid channels below the resonant cavity and above the third layer for conducting cooling fluid about the distributor.

14. The distributor of claim 13 further comprising a plurality of holes in the resonant cavity for conducting cooling fluid between the cavity and the cooling fluid channels.

15. The distributor of claim 13 wherein at least a portion of the cooling fluid channels are contiguous with a wall of the cavity.

16. The distributor of claim 9 wherein the cavity comprises a plurality of resonant cavities defined by the second layer and arranged as adjacent rectangles to form a two dimensional grid of cavities.

17. An EHF band wave distributor comprising:

a plurality of resonant cavities, each cavity having at least a floor and a cover;

a network of waveguides disposed below the floors, each waveguide being fed by a single source of radiation;

a plurality of slots in the floor of each cavity, the slots being in electromagnetic communication with the waveguides for establishing a predetermined standing wave pattern in each respective cavity;

a plurality of coupling probes protruding through the cover of each cavity, each probe electromagnetically coupling a respective radiating element to the standing wave pattern in a corresponding cavity.

18. The distributor of claim 17 wherein the cavities are arranged as adjacent rectangles to form a two dimensional grid of cavities.

19. The distributor of claim 18 wherein the adjacent rectangles abut one another.

20. The distributor of claim 18 wherein the grid comprises four cavities in each of the two dimensions of the grid for a total of sixteen cavities.

21. The distributor of claim 17 further comprising an array of subarray modules, each module corresponding to a different one of the cavities, each module containing a portion of the coupling probes.

22. The distributor of claim 21 wherein each subarray modules has a direct solder connection to the respective cavity cover through which its respective coupling probes extend.

23. The distributor of claim 21 wherein each subarray module contains sixteen coupling probes.

24. The distributor of claim 17 wherein the cavity covers comprise a single metal matrix composite sheet.

25. The distributor of claim 17 further comprising means, associated with the resonant cavities for cooling the resonant cavities.

26. The distributor of claim 25 wherein the cooling means comprises a network of cooling fluid channels below the floors of the cavities for conducting cooling fluid about the distributor.

27. The cooling means of claim 26 further comprising a plurality of holes in the cavity floors for conducting cooling fluid between the cavities and the cooling fluid channels.

28. The cooling means of claim 26 wherein at least a portion of the cooling fluid channels are contiguous with the cavity floors.

29. The distributor of claim 26 wherein the cooling fluid comprises air.

30. The distributor of claim 25 wherein the cooling means comprises an array of heat pipes disposed adjacent the resonant cavities.

* * * * *